US009909757B2

(12) United States Patent
Colannino

(10) Patent No.: US 9,909,757 B2
(45) Date of Patent: Mar. 6, 2018

(54) LOW NOX BURNER AND METHOD OF OPERATING A LOW NOX BURNER

(71) Applicant: Joseph Colannino, Bellevue, WA (US)

(72) Inventor: Joseph Colannino, Bellevue, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 441 days.

(21) Appl. No.: 14/556,495

(22) Filed: Dec. 1, 2014

(65) Prior Publication Data

US 2015/0140498 A1 May 21, 2015

Related U.S. Application Data

(63) Continuation of application No. PCT/US2013/043658, filed on May 31, 2013.

(60) Provisional application No. 61/669,634, filed on Jul. 9, 2012, provisional application No. 61/653,722, filed on May 31, 2012.

(51) Int. Cl.

| | |
|---|---|
| ***F23C 99/00*** | (2006.01) |
| ***F23D 14/82*** | (2006.01) |
| ***F23D 14/02*** | (2006.01) |
| ***F23D 11/40*** | (2006.01) |

(52) U.S. Cl.

CPC ..... *F23C 99/001* (2013.01); *F23D 11/406* (2013.01); *F23D 14/02* (2013.01); *F23D 14/82* (2013.01)

(58) Field of Classification Search

CPC ..... F23C 99/001
USPC ..... 431/2, 253
See application file for complete search history.

(56) References Cited

U.S. PATENT DOCUMENTS

| | | | | |
|---|---|---|---|---|
| 2,604,936 | A | 7/1952 | Kaehni et al. | |
| 2,942,420 | A | 6/1960 | Clark | |
| 3,167,109 | A | 1/1965 | Wobig | |
| 3,224,485 | A | 12/1965 | Blomgren et al. | |
| 3,301,307 | A | 1/1967 | Nishigaki et al. | |
| 3,306,338 | A | 2/1967 | Wright et al. | |
| 3,358,731 | A | 12/1967 | Donnelly | |
| 3,416,870 | A | 12/1968 | Wright | |
| 3,749,545 | A | 7/1973 | Velkoff | |
| 3,841,824 | A * | 10/1974 | Bethel | F23C 99/001 123/536 |
| 4,020,388 | A | 4/1977 | Pratt, Jr. | |

(Continued)

FOREIGN PATENT DOCUMENTS

| | | |
|---|---|---|
| EP | 0844434 | 5/1998 |
| EP | 1139020 | 8/2006 |

(Continued)

OTHER PUBLICATIONS

M. Zake et al., "Electric Field Control of NOx Formation in the Flame Channel Flows." Global Nest: The Int. J. May 2000, vol. 2, No. 1, pp. 99-108.

(Continued)

*Primary Examiner* — Avinash Savani
*Assistant Examiner* — Aaron Heyamoto
(74) *Attorney, Agent, or Firm* — Christopher A. Wiklof; Nicholas S. Bromer; Launchpad IP, Inc.

(57) ABSTRACT

A low NOx burner is configured to support a combustion reaction at a selected fuel mixture by anchoring a flame at a conductive flame anchor responsive to current flow between charges carried by the flame and the conductive flame anchor.

23 Claims, 5 Drawing Sheets

(56) References Cited

U.S. PATENT DOCUMENTS

| | | | | |
|---|---|---|---|---|
| 4,091,779 | A | 5/1978 | Saufferer et al. | |
| 4,111,636 | A | 9/1978 | Goldberg | |
| 5,515,681 | A | 5/1996 | DeFreitas | |
| 5,641,282 | A * | 6/1997 | Lee | F23D 14/16 126/91 A |
| 5,702,244 | A | 12/1997 | Goodson et al. | |
| 5,784,889 | A | 7/1998 | Joos et al. | |
| 6,247,921 | B1 | 6/2001 | Helt | |
| 7,137,808 | B2 | 11/2006 | Branston et al. | |
| 7,159,646 | B2 | 1/2007 | Dessiatoun et al. | |
| 7,243,496 | B2 | 7/2007 | Pavlik et al. | |
| 7,523,603 | B2 | 4/2009 | Hagen et al. | |
| 8,245,951 | B2 | 8/2012 | Fink et al. | |
| 8,881,535 | B2 | 11/2014 | Hartwick et al. | |
| 9,267,680 | B2 | 2/2016 | Goodson et al. | |
| 9,284,886 | B2 | 3/2016 | Breidenthal et al. | |
| 9,289,780 | B2 | 3/2016 | Goodson | |
| 9,366,427 | B2 | 6/2016 | Sonnichsen et al. | |
| 9,377,195 | B2 | 6/2016 | Goodson et al. | |
| 9,453,640 | B2 | 9/2016 | Krichtafovitch et al. | |
| 2004/0185397 | A1 | 9/2004 | Branston et al. | |
| 2005/0208442 | A1* | 9/2005 | Heiligers | F23B 7/00 431/1 |
| 2006/0165555 | A1 | 7/2006 | Spielman et al. | |
| 2007/0020567 | A1 | 1/2007 | Branston et al. | |
| 2008/0145802 | A1 | 6/2008 | Hammer et al. | |
| 2010/0183424 | A1 | 7/2010 | Roy | |
| 2011/0027734 | A1 | 2/2011 | Hartwick et al. | |
| 2011/0072786 | A1 | 3/2011 | Tokuda et al. | |
| 2011/0203771 | A1 | 8/2011 | Goodson et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0260321 | A1 | 10/2013 | Colannino et al. | |
| 2013/0291552 | A1 | 11/2013 | Smith et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0208758 | A1 | 7/2014 | Breidenthal et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0147705 | A1 | 5/2015 | Colannino et al. | |
| 2015/0338089 | A1 | 11/2015 | Krichtafovitch et al. | |
| 2016/0123576 | A1 | 5/2016 | Colannino et al. | |
| 2016/0245507 | A1 | 8/2016 | Goodson et al. | |

FOREIGN PATENT DOCUMENTS

| | | |
|---|---|---|
| EP | 2738460 | 6/2014 |
| FR | 2577304 | 12/1989 |
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | 2001-021110 | 1/2001 |
| JP | 2001-056120 | 2/2001 |
| WO | WO 1996/001394 | 1/1996 |
| WO | WO 2012/109499 | 8/2012 |

OTHER PUBLICATIONS

James Lawton et al., Electrical Aspects of Combustion, 1969, p. 81, Clarendon Press, Oxford, England.

PCT International Search Report and Written Opinion of International PCT Application No. PCT/US2013/043658 dated Sep. 13, 2013.

* cited by examiner

FIG. 2

Entrainment Model

201

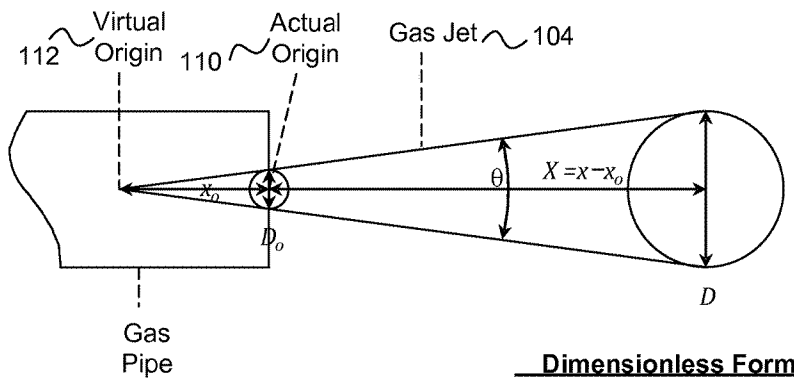

Nomenclature

- $A$ = jet area at position $x$
- $A_o$ = area of the orifice
- $c$ = fuel concentration at position $x$
- $c_o$ = fuel concentration at the orifice
- $D$ = jet diameter
- $D_o$ = orifice diameter
- $v$ = jet velocity at position $x$
- $v_o$ = jet velocity at the orifice
- $x$ = distance from virtual origin
- $x_o$ = distance from orifice to virtual origin
- $X$ = entrainment length
- $X_\lambda$ = critical entrainment length
- $\lambda$ = flammability limit, upper or lower
- $\theta$ = angle of jet spread

Dimensionless Formulas

$$\frac{X_\lambda}{D_o} = \frac{\frac{1}{\lambda} - \sqrt{\frac{\rho}{\rho_o}}}{2\sqrt{\frac{\rho}{\rho_o}}\tan\left(\frac{\theta}{2}\right)}$$

critical entrainment length $$\frac{D}{D_o} = 2\left(\frac{X_E}{D_o}\right)\tan\left(\frac{\theta}{2}\right) + 1$$

jet spread $$\frac{v_o}{v} = \frac{c_o}{c} = \frac{D}{D_o}\sqrt{\frac{\rho}{\rho_o}}$$

velocity and concentration profiles

LOW NOX BURNER AND METHOD OF OPERATING A LOW NOX BURNER

CROSS-REFERENCE TO RELATED APPLICATIONS

The present application is a U.S. Continuation Application which claims priority benefit under 35 U.S.C. § 120 (pre-AIA) of co-pending International Patent Application No. PCT/US2013/043658, entitled "LOW NOx BURNER AND METHOD OF OPERATING A LOW NOx BURNER", filed May 31, 2013; which application claims priority benefit U.S. Provisional Patent Application No. 61/669,634, entitled "LOW NOx BURNER AND METHOD OF OPERATING A LOW NOx BURNER", filed Jul. 9, 2012, and U.S. Provisional Patent Application No. 61/653,722, entitled "LOW $NO_x$ LIFTED FLAME BURNER", filed May 31, 2012; each of which, to the extent not inconsistent with the disclosure herein, is incorporated by reference.

BACKGROUND

The various oxides of nitrogen, known collectively as NOx, and often present primarily in the mono-oxide form NO, form a major component of air pollution including noxious photochemical smog. NOx is typically generated when nitrogen and oxygen in the air combine at high temperatures during the burning of fuel in internal combustion engines; gas turbines; industrial, commercial and residential burners; industrial, commercial, and residential boilers; and/or other combustion applications.

Low NOx burners have been developed but may suffer from relatively high complexity and cost. Low NOx burners may further suffer from relatively poor flame stability and may be prone to flame blow-out. To overcome the tendency to undergo flame blow-out, low NOx burners may typically be operated under a relatively narrow range of turn-down ratios. Because of the effect of reduced turn-down ratio, low NOx burners may typically operate with relatively limited dynamic range with respect to power or heat output, which may be expressed as BTU/hour.

What is needed is a low NOx burner with greater simplicity and/or reduced cost compared to previous low NOx burners. What is additionally or alternatively needed is a low NOx burner that exhibits improved flame stability and/or that is amenable to operation over a relatively wide dynamic range such as to provide load matching.

SUMMARY

According to embodiments, a method of reducing the formation of oxides of nitrogen (NOx) evolved from a combustion reaction includes reducing the combustion temperature by operating near a fuel dilution limit.

According to an embodiment, a low NOx burner includes a conductive flame holder supported proximate a diverging fuel stream at a distance along the diverging fuel stream corresponding to a desired fuel concentration, oxygen concentration, fuel/oxygen stoichiometry, or combination thereof. A charge source is configured to impart a charge concentration on a flame surface held by the conductive flame holder. The imparted charge concentration can be selected to cause the flame to remain ignited and in contact with the conductive flame holder.

According to an embodiment, a method of operating a low NOx burner includes supporting a conductive flame holder proximate a diverging fuel stream at a selected distance along the diverging fuel stream and imparting a charge onto a flame held by the conductive flame holder and supported by the diverging fuel stream. The diverging fuel stream is supplied by a nozzle. Flame holding and flame ignition are maintained responsive to cooperation between the imparted charge on the flame and the conductive flame holder.

According to an embodiment, in a low NOx burner, a conductive flame holder is supported at a distance from a fuel nozzle emitting a diverging fuel stream. The distance can be selected to correspond to a desired property of the fuel/air mixture, for example the flammability limit of the mixture. An electric charge source imparting a charge to the flame surface operates in cooperation with the conductive flame holder to cause the flame to remain ignited and in contact with the conductive flame holder. This allows the use of leaner fuel/air mixtures, reducing the flame temperature and lowering NOx production. Mixing of the fuel and air can be increased, further reducing NOx production. Optionally, a sensor is used to monitor the flame condition. Optionally, the position or configuration of the conductive flame holder is automatically or manually adjusted to maintain a desired flame condition.

BRIEF DESCRIPTION OF THE DRAWINGS

FIG. 2 is a diagram showing divergence of a fuel stream passing through a diluent, according to an embodiment.

DETAILED DESCRIPTION

Figure 1:
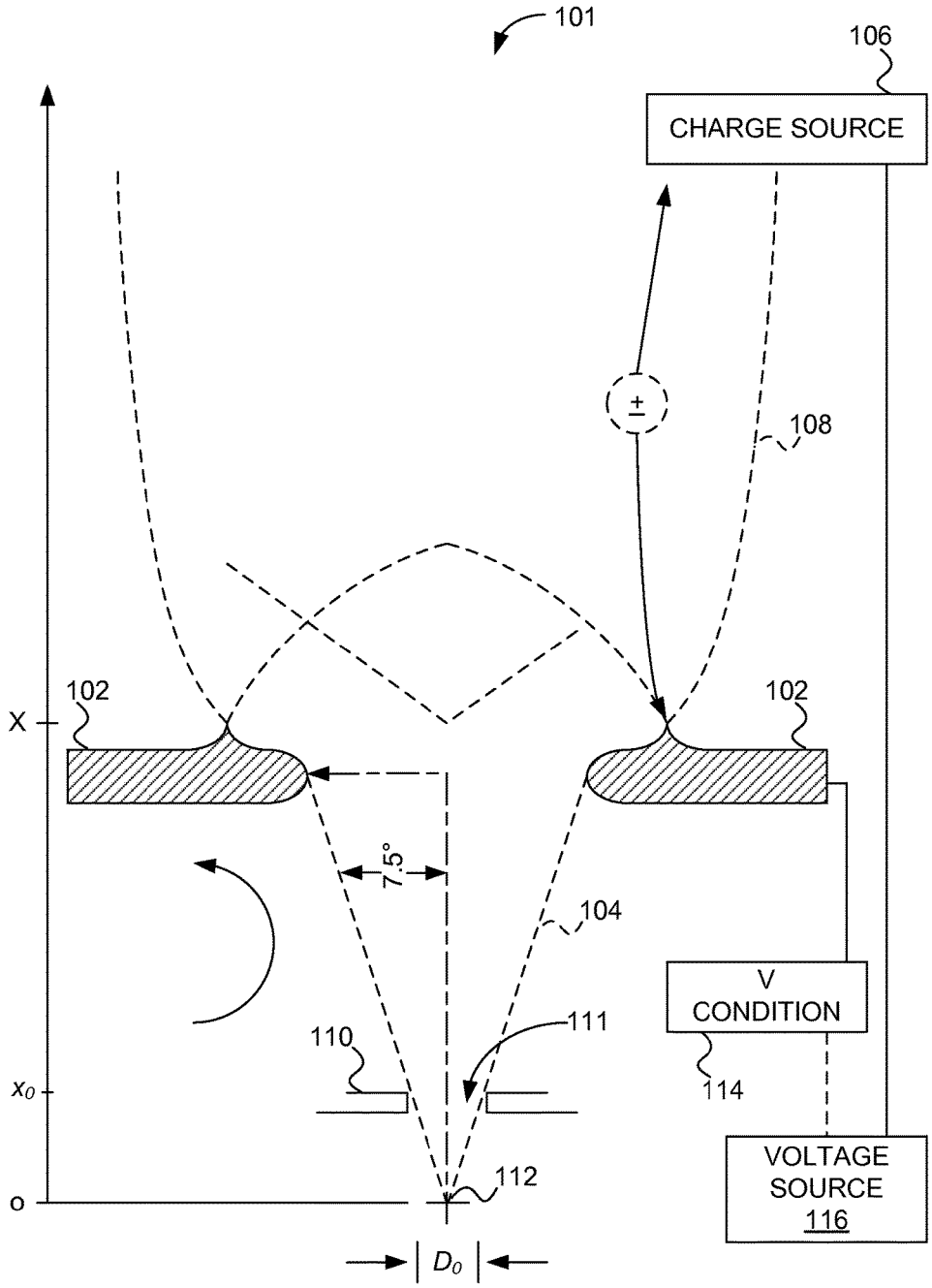
FIG. 1 is a diagram of a low oxides of nitrogen (NOx) burner, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a cross-sectional view of portion of a low oxides of nitrogen (NOx) burner 101, according to an embodiment. The low NOx burner 101 includes a conductive flame holder 102 supported proximate the diverging fuel stream 104 at a distance X along the diverging fuel stream 104. The distance X corresponds to a desired fuel concentration, oxygen concentration, fuel and oxygen stoichiometry, or combination thereof. A charge source 106 is configured to impart a charge concentration on a flame surface 108 held by the conductive flame holder 102. The imparted charge concentration is selected to cause the flame to remain ignited and in contact with the conductive flame holder 102.

According to an embodiment, the fuel stream 104 may diverge at a substantially constant angle from the fuel nozzle 110. The expansion in stream area corresponds to dilution of the fuel by entrainment of a surrounding fluid. For example, the surrounding fluid can include air and/or recycled flue gas. If the surrounding fluid is air, for example, the entrained fluid is about 21% oxygen, 78% nitrogen, and a small amount of other gases. If the surrounding fluid includes a flue gas recycle, for example, the entrained fluid can include about 2% to 5% oxygen, about 78% nitrogen, and combustion products such as carbon dioxide, water vapor and other combustion products found in the flue gas. Recycling flue gas for entrainment with the fuel stream 104 can thus result in a lower concentration of oxygen mixed with the fuel.

Less NOx can be output from a burner supporting a flame having a relatively low temperature. A flame 108 burned near a lean flammability limit can have a lower temperature than a flame burned richer, and can thus output less NOx than a flame burned richer. A flame 108 burned in a lower concentration of oxygen can output less NOx than a flame burned in a higher concentration of oxygen. Moreover, a well-mixed flame 108 tends to output less NOx than a poorly-mixed flame.

According to an embodiment, the distance X is selected to correspond to be at or slightly above a lean flammability limit of the fuel under the operating conditions. The application of charges to the flame 108 by the flame charge source 106 has been found to improve flame mixing. These effects cause the burner 101 to exhibit low NOx output.

According to an embodiment, the distance X along an axis of the diverging fuel stream 104 includes a distance $x_0$ from a point 112 to a fuel nozzle 110 plus a distance $X_E=X-x_0$ from the fuel nozzle 110. The distance $x_0$ is a function of the size $D_0$ of the aperture 111 in the fuel nozzle 110 through which the fuel stream 104 is emitted. The point 112 may be considered a virtual origin of the diverging fuel stream 104.

FIG. 2 is a diagram showing the divergence of a fuel stream 104 at a substantially constant angle θ from a fuel nozzle 110 having a diameter $D_0$. Due to the entrainment of air or other surrounding fluid by the diverging fuel stream 104, the diameter D of the diverging fuel stream 104 increases with distance from the fuel nozzle 110. If $X_E$ is the distance from the fuel nozzle 110 along the central axis of the diverging fuel stream 104, it has been found that the diameter D of the fuel stream at distance $X_E$ may obey the relationship:

$$\frac{D}{D_0} = 2\left(\frac{X_E}{D_0}\right)\tan\left(\frac{\theta}{2}\right) + 1$$

The fuel becomes increasingly diluted by the entrainment of surrounding air, flue gas, or other fluid as the diverging fuel stream 104 proceeds from the fuel nozzle 110. In other words, the fuel mixture becomes increasingly lean with increasing distance from the fuel nozzle 110. If the fuel/oxidizer mixture becomes so lean that it will barely support combustion, it may be said that a lean flammability limit has been reached.

Referring again to FIG. 1, the distance X includes a distance $X_E$ from the fuel nozzle 110 plus a distance $x_0$ to the virtual origin point 112 upstream from the fuel nozzle aperture 111, according to an embodiment. The distance X can, for example, correspond substantially to a lean flammability limit of the fuel in the diverging fuel stream 104. The angle of divergence of fuel stream 104 is a substantially 15-degree solid angle, alternatively referred to as a substantially 7.5-degree angle of divergence from an axis of fuel transport.

The burner 101 can optionally also include an adjustable support (not shown) configured to change the distance X at which the conductive flame holder 102 is supported responsive to a change in the lean flammability limit or other operating parameter of the burner 101, according to an embodiment. An electronic control module (not shown) may be configured to select the distance X along the diverging fuel stream 104 at which the conductive flame holder 102 is supported.

According to an embodiment, the conductive flame holder 102 is shaped to define an aperture corresponding at least approximately to a fuel stream diameter at the distance X. The conductive flame holder 102 includes a conductive ring. The conductive flame holder 102 can additionally or alternatively include a circular tension conductive structure. The conductive flame holder 102 can include a composite assembly configured to adapt the shape of the conductive flame holder 102 to a selected corresponding diverging fuel stream 104 diameter. The conductive flame holder 102 can include a plurality of conductive flame holders sized to correspond to respective selected diameters corresponding to the diverging fuel stream 104. Optionally, the conductive flame holder 102 may include a sharp electrode. Optionally, the conductive flame holder 102 may include a substantially dull electrode.

The low-NOx burner 101 includes, operatively coupled to or forming a portion of the conductive flame holder 102, a node 114 having a selected voltage condition, according to an embodiment. The selected voltage condition of the node 114 includes a voltage different than a voltage applied by the charge source 106 to the flame 108. The selected voltage condition of the node 114 can include a second time-varying voltage corresponding to the electrically conductive surface, the second time-varying voltage being opposite in sign to a first time-varying voltage applied to the charge source 106. Alternatively, the selected voltage condition of the node 114 can include substantially voltage ground. Alternatively, the selected voltage condition of the node 114 can include electrical isolation from ground and from voltages other than the voltage corresponding to the charges imparted onto the flame 108 by the charge source 106.

According to an embodiment, a voltage source 116 is configured to apply a voltage to the charge source 106. The charge source 106 is configured to impart the charge concentration on the flame 108 responsive to the applied voltage. The voltage source 116 can be configured to apply a substantially constant voltage to the charge source 106. Additionally or alternatively, the voltage source 116 can be configured to apply a time-varying voltage to the charge source 106. The time-varying voltage may include a periodic voltage waveform having a 50 to 10,000 Hertz frequency. For example, the time-varying voltage can include a periodic voltage waveform having a 200 to 800 Hz frequency. The time-varying voltage can include a square waveform, sine waveform, triangular waveform, truncated triangular waveform, sawtooth waveform, logarithmic waveform, or exponential waveform, for example. The time-varying voltage can include a waveform having a ±1,000 volt to ±115,000 volt amplitude. For example, the time-varying voltage can include a waveform having a ±8,000 volt to ±40,000 volt amplitude.

According to an embodiment, the charge source 106 can include a sharp electrode such as an electrode configured to eject charges into a dielectric region near the flame 108. A charge ejecting electrode may be referred to as a corona electrode, for example. The charge source can additionally or alternatively include a substantially dull electrode. The charge source 106 can include a depletion electrode configured to deplete ions or electrons having a non-majority charge sign from the flame. Alternatively, the charge source 106 can include a charge adding apparatus configured to apply the majority charge to the flame.

Figure 3:
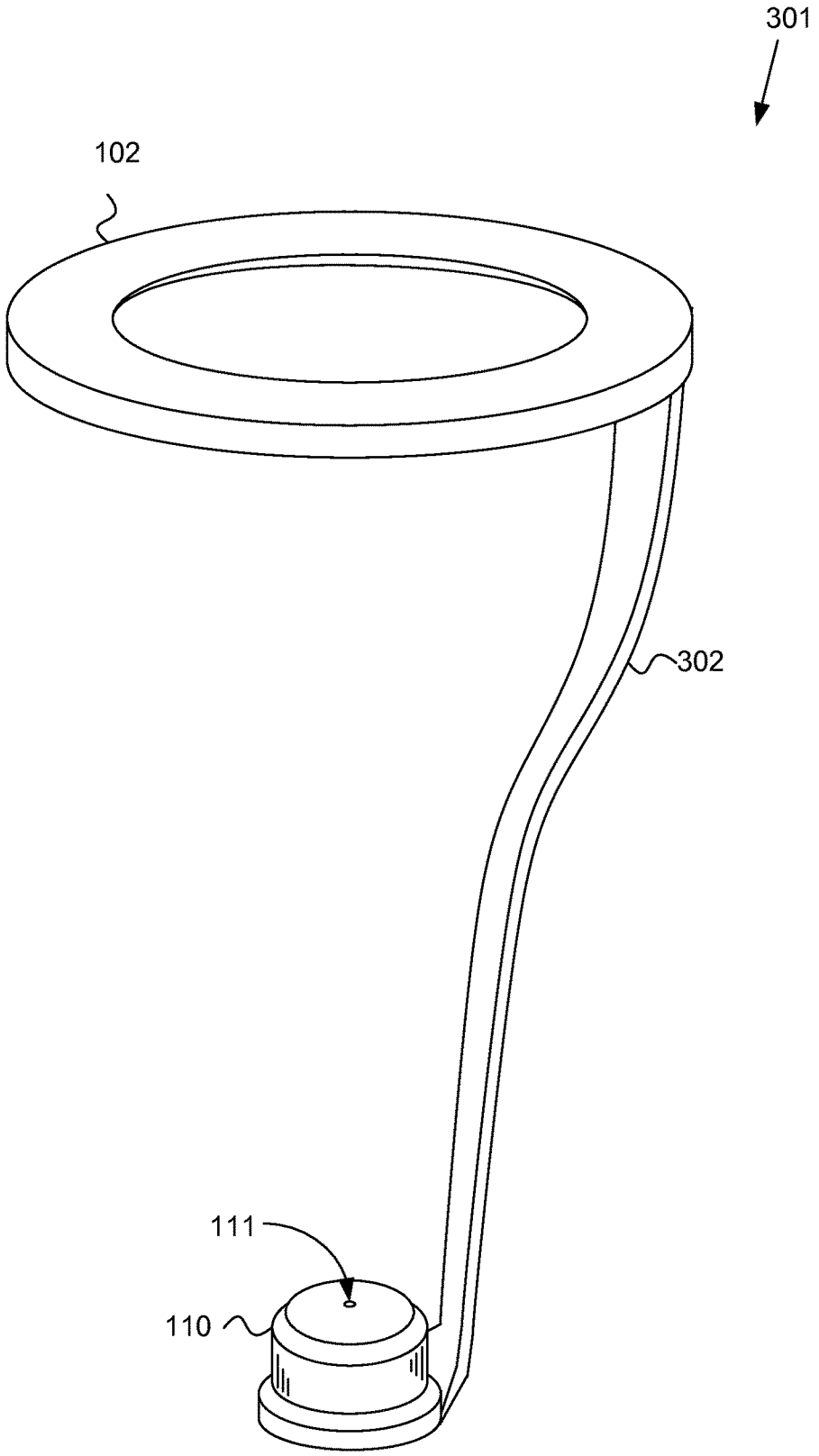
FIG. 3 is a perspective view of an integrated conductive flame holder, according to an embodiment.

FIG. 3 is a view of an integrated conductive flame holder 301, according to an embodiment. The integrated conductive flame holder 301 includes a conductive flame holding surface 102 and a conductive flame holder support 302 mechanically coupled to the conductive flame holding surface 102 and configured for mechanical coupling to another surface. For example, the conductive flame holder support 302 can mechanically coupled to the fuel nozzle 110, as shown in FIG. 3. The conductive flame holder 102 and the fuel nozzle 110 can be mechanically coupled to form an integrated fuel nozzle and conductive flame holder 301.

The conductive flame holder 102, the flame holder support 302, and/or the fuel nozzle 110 can be joined by a variety of couplings. Various combinations of couplings can be combined. For example, the conductive flame holder 102, the flame holder support 302, and/or the fuel nozzle 110 can be joined by threaded fasteners. The conductive flame holder 102, the flame holder support 302, and/or the fuel nozzle 110 can be joined by one or more rivets. The conductive flame holder 102, the flame holder support 302, and/or the fuel nozzle 110 can be joined by one or more weldments. The conductive flame holder 102, the flame holder support 302, and/or the fuel nozzle 110 can be joined by one or more brazed fittings. The conductive flame holder 102, the flame holder support 302, and/or the fuel nozzle 110 can be joined by one or more held-together surfaces. The conductive flame holder 102, the flame holder support 302, and/or the fuel nozzle 110 can be joined by one or more cold-formed joints. The conductive flame holder 102, the flame holder support 302, and/or the fuel nozzle 110 can be joined by one or more pressure-formed angles. The conductive flame holder 102, the flame holder support 302, and/or the fuel nozzle 110 can be joined by one or more co-molded interfaces. The conductive flame holder 102, the flame holder support 302, and/or the fuel nozzle 110 can be formed from or joined by one or more sintered shapes. The conductive flame holder 102, the flame holder support 302, and/or the fuel nozzle 110 can be joined by and one or more die-cast features. Additionally or alternatively, the conductive flame holder 102, the flame holder support 302, and the fuel nozzle 110 can be formed as a single piece. The fuel nozzle 110 can be conductive. The conductive flame holder 102, the flame holder support 302, and the fuel nozzle 110 can be aligned such that a fuel aperture 111 in the fuel nozzle 110 is aligned to cause the diverging fuel stream (not shown) to pass substantially along a common centerline through the fuel aperture 111 and the aperture formed by the conductive flame holder 102.

Figure 4:
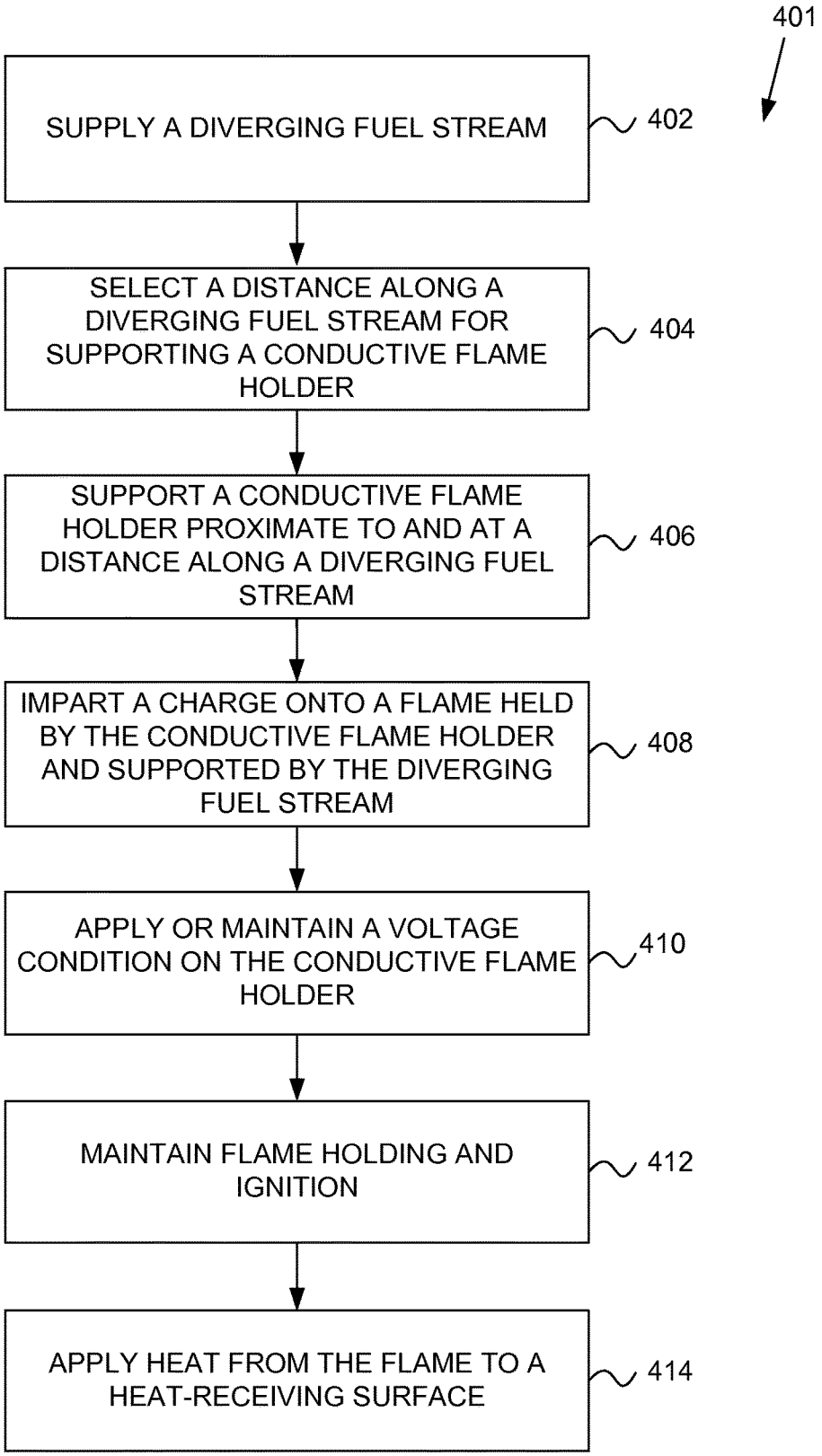
FIG. 4 is a flow chart showing a method for operating a low NOx burner, according to an embodiment.

FIG. 4 is a flow chart showing a method 401 for operating a low NOx burner, according to an embodiment. In step 402, a diverging fuel stream is provided. In step 406, a conductive flame holder is supported proximate a diverging fuel stream at a selected distance along the diverging fuel stream. Proceeding to step 408, a charge is imparted onto a flame held by the conductive flame holder and supported by the diverging fuel stream. In step 412, flame holding and flame ignition are maintained responsive to the cooperation between the imparted charge on the flame and the conductive flame holder.

Proceeding to step 414, heat from the flame is applied to a heat-receiving surface. For example, applying heat to a heat-receiving surface can include providing heat in a furnace, in a boiler, in a gas turbine, or in a process material heater.

In step 406, the selected distance along the diverging fuel stream can, for example, substantially correspond to a flammability limit of the fuel.

Optionally, the method 401 includes step 404 wherein the selected distance is determined. According to an embodiment, determining the selected distance includes receiving a signal or operating a sensor to generate a signal indicative of a fuel condition, for example. The distance X along a stream of the fuel is calculated or looked up. The distance X has a relationship to a lean flammability limit corresponding to the fuel condition, for example. The distance X, data corresponding to the distance X, or a signal corresponding to the distance X is output. The output drives a conductive flame holder support to the distance X or an indication of the distance X can be output on an instrument for viewing by a user (e.g., an operating engineer) for manual adjustment of the distance X.

The method 401 may optionally include driving an actuator to support the conductive flame holder at the selected distance along the diverging fuel stream (not shown).

The method 401 also includes applying a voltage to the charge source. The charge source imparts the charge concentration responsive to the applied voltage. Applying a voltage to the charge source can optionally include applying a time-varying voltage to the charge source. Applying a voltage to the charge source can include applying a periodic voltage waveform having a 50 to 10,000 Hertz frequency. For example, applying a voltage to the charge source can include applying a periodic voltage waveform having a 200 to 800 Hertz frequency. Applying a voltage to the charge source can include applying a square waveform, sine waveform, triangular waveform, truncated triangular waveform, sawtooth waveform, logarithmic waveform, or exponential waveform. Applying a voltage to the charge source can include applying a waveform having ±1000 volt to ±115,000 volt amplitude. For example, applying a voltage to the charge source can include applying a waveform having ±8000 volt to ±40,000 volt amplitude.

In step 408, imparting a charge can include applying a voltage to a sharp electrode proximate to the flame. Alternatively, imparting a charge can include applying a voltage to a substantially dull electrode proximate to the flame. Imparting a charge can optionally include applying a voltage to a depletion electrode configured to deplete from the flame ions or electrons having a non-majority charge sign. Additionally or alternatively, imparting a charge can include applying a voltage to a charge adding apparatus configured to apply the majority charge to the flame.

The method 401 includes step 410, wherein a voltage condition is applied to or maintained on the conductive flame holder, according to an embodiment. Applying or maintaining a voltage condition to the conductive flame holder includes applying a voltage different than a voltage applied to a charge source that imparts the charge onto the flame. Additionally or alternatively, applying or maintaining a voltage condition on the conductive flame holder can include applying a second time-varying voltage to the electrically conductive surface, the second time-varying voltage being opposite in sign to a time-varying charge imparted onto the flame. Alternatively, applying or maintaining a voltage condition on the conductive flame holder can include maintaining substantially voltage ground. Additionally or alternatively, applying or maintaining a voltage condition to the conductive flame holder can include maintaining electrical isolation from ground and from voltages other than the voltage corresponding to the charges imparted onto the flame.

Figure 5:
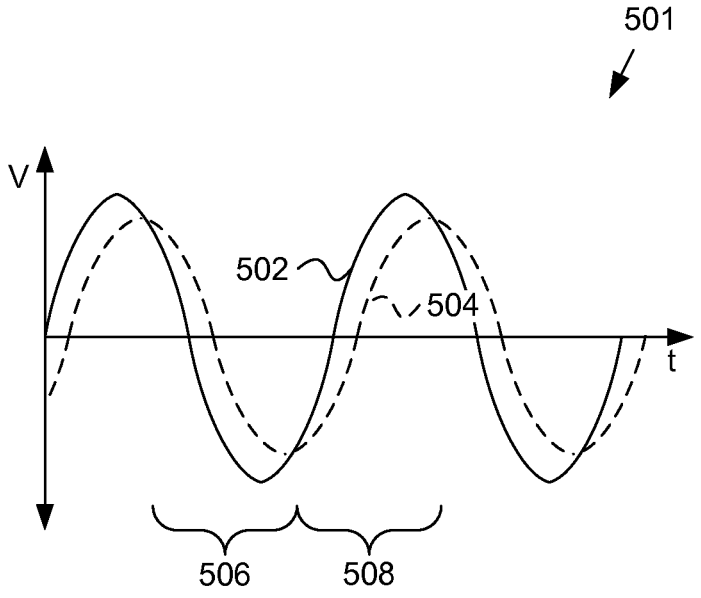
FIG. 5 is a diagram showing an illustrative mechanism for flame holding phenomena described in conjunction with FIGS. 1-4, according to an embodiment.

FIG. 5 is a diagram 501 illustrating a theory explaining the behavior of the methods and systems described in conjunction with FIGS. 1-4, according to an illustrative embodiment. In the diagram 501, voltage, V, is plotted as a function of time, t. A first voltage waveform 502, shown as a solid line approximating a sine wave, corresponds to a time-varying voltage applied to the charge source 106 described above. When the conductive flame holder 102 is allowed to float, its voltage can be described by a phase-shifted waveform 504, shown as a dashed line. As the first voltage waveform 502 applied to the charge source 106 increases, the voltage 504 of the conductive flame holder 102 follows.

According to an embodiment, during a first half cycle 506 of the system, the voltage 502 applied by the charge source 106 to the flame is lower than the voltage 504 responsively held by the conductive flame holder 102. During the first half cycle 506, electrons are attracted out of at least portions of the flame toward the conductive flame holder 102. Similarly, positively charged species are attracted from proximity to the conductive flame holder 102 toward the flame. Current flow corresponding to flow of electrons toward the conductive flame holder 102 correspond (during the first half cycle 506) to the holding of the flame to the conductive flame holder 102.

During a second half cycle 508 of the system, the voltage 502 applied by the charge source 106 to the flame is higher than the voltage 504 responsively held by the conductive flame holder 102. During the second half cycle 508, electrons are attracted from proximity to the conductive flame holder 102 and into the flame and positive species are attracted from the flame and into proximity with the conductive flame holder 102. Current flow corresponding to flow of positive ions toward the conductive flame holder 102 (or flow of electrons away from the conductive flame holder 102) corresponds (during the second half cycle 508) to the holding of the flame to the conductive flame holder 102.

According to an embodiment, the movement of charged species to and from the conductive flame holder 102 acts to initiate the combustion reaction. For example, the charged species tend to combine with fuel or oxygen to form reactive species that participate in the combustion reaction. Alternatively, the charge species tend to attract oppositely charged species from fuel or oxygen, with the remaining fuel or oxygen fragment being a reactive species that participates in the combustion reaction.

A method of determining a distance X along a fuel stream for supporting a conductive flame holder may include receiving a signal or operating a sensor to generate a signal indicative of a fuel condition, calculating or looking up a distance X along a stream of the fuel, the distance X having a relationship to a lean flammability limit corresponding to the fuel condition, and outputting the distance X, data corresponding to the distance X, or a signal corresponding to the distance X to drive a conductive flame holder support to the distance X or outputting an indication of the distance X on an instrument for viewing by a user.

According to an embodiment, a non-transitory computer readable media carries computer executable instructions configured to cause an electronic control module to perform a method including the steps of receiving a signal or operating a sensor to generate a signal indicative of a fuel condition, calculating or looking up a distance along a stream of the fuel, the distance having a relationship to a lean flammability limit corresponding to the fuel condition. The computer readable media can also carry computer executable instructions for outputting the distance, outputting data corresponding to the distance, or outputting a signal corresponding to the distance to drive a conductive flame holder support to the distance. Additionally or alternatively, the computer readable media can also carry computer executable instructions for outputting an indication of the distance on an instrument for viewing by a user.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method of operating a low oxides of nitrogen (NOx) burner, comprising:

emitting a diverging fuel stream from a fuel nozzle, the fuel stream diverging at a substantially constant angle from the fuel nozzle, thereby increasing a diameter of the diverging fuel stream with distance from the fuel nozzle;

entraining air or other surrounding fluid in the diverging fuel stream;

supporting a conductive flame holder proximate the diverging fuel stream at a position along the diverging fuel stream that substantially corresponds to a flammability limit of the fuel;

imparting an electric charge onto a flame surface held by the conductive flame holder and supported by the diverging fuel stream;

applying or maintaining a voltage condition to the conductive flame holder;

wherein applying or maintaining a voltage condition to the conductive flame holder includes applying a voltage different than a voltage applied to a charge source that imparts the charge onto the flame; and causing electrical current to flow between the flame and the conductive flame anchor.

2. The method of operating a low NOx burner of claim 1, wherein:

cooperation between the imparted charge on the flame and the conductive flame holder maintains ignition of the flame and flame holding by the conductive flame holder.

3. The method of operating a low NOx burner of claim 1, further comprising:

applying heat from the flame to a heat-receiving surface.

4. The method of operating a low NOx burner of claim 1, further comprising determining a selected distance between the conductive flame holder and the fuel nozzle generating the diverging fuel stream, and wherein determining the selected position further comprises:

receiving a signal or operating a sensor to generate a signal indicative of a fuel condition;

calculating or looking up a position along a stream of the fuel, the position having a relationship to a lean flammability limit corresponding to the fuel condition; and outputting the position data corresponding to the position or a signal corresponding to the position to drive a conductive flame holder support to the position or outputting an indication of the position on an instrument for viewing by a user.

5. The method of operating a low NOx burner of claim 4, further comprising:

driving an actuator to support the conductive flame holder at the selected position along the diverging fuel stream.

6. The method of operating a low NOx burner of claim 1, further comprising:

applying a voltage to the charge source;

wherein the charge source imparts the charge concentration responsive to the applied voltage.

7. The method of operating a low NOx burner of claim 6, wherein applying a voltage to the charge source includes applying a time-varying voltage to the charge source.

8. The method of operating a low NOx burner of claim 7, wherein applying a voltage to the charge source includes applying a periodic voltage waveform.

9. The method of operating a low NOx burner of claim 1, wherein imparting a charge includes applying a voltage to a sharp electrode proximate to the flame.

10. The method of operating a low NOx burner of claim 1, wherein imparting a charge includes applying a voltage to a substantially dull electrode proximate to the flame.

11. The method of operating a low NOx burner of claim 1, wherein imparting a charge includes applying a voltage to a depletion electrode configured to deplete from the flame ions or electrons having a non-majority charge sign.

12. The method of operating a low NOx burner of claim 1, wherein imparting a charge includes applying a voltage to a charge adding apparatus configured to apply a majority charge to the flame.

13. The method of operating a low NOx burner of claim 1, wherein applying or maintaining a voltage condition to the conductive flame holder includes applying a second time-varying voltage to the conductive flame holder, the second time-varying voltage being opposite in sign to the charge imparted onto the flame.

14. The method of operating a low NOx burner of claim 1, wherein applying or maintaining a voltage condition to the conductive flame holder includes maintaining substantially voltage ground.

15. The method of operating a low NOx burner of claim 1, wherein applying or maintaining a voltage condition to the conductive flame holder includes maintaining electrical isolation from ground and from voltages other than the voltage corresponding to the charges imparted onto the flame.

16. The method of operating a low NOx burner of claim 1, including selecting a diameter of the diverging fuel stream, and adapting a shape of the conductive flame holder to the diameter of the diverging fuel stream.

17. The method of operating a low NOx burner of claim 1, including selecting a diameter of the diverging fuel stream, and selecting the conductive flame holder to have a conductive flame holder diameter corresponding to the diameter of the diverging fuel stream.

18. The method of operating a low NOx burner of claim 1, wherein the conductive flame holder includes a conductive flame holding surface, and further comprising:

providing a conductive flame-holder support configured for mechanically coupling the conductive flame holding surface; and using the conductive flame-holder support to mechanically couple to the conductive flame holding surface and configured for mechanical coupling to another surface.

19. The method of operating a low NOx burner of claim 18, wherein the other surface comprises the fuel nozzle that supports the diverging fuel stream.

20. The method of operating a low NOx burner of claim 19, wherein the conductive flame holder and the fuel nozzle are mechanically coupled to form an integrated, non-unitary fuel nozzle and conductive flame holder.

21. The method of operating a low NOx burner of claim 19, wherein the conductive flame holder and the fuel nozzle are formed as a unitary single piece.

22. The method of operating a low NOx burner of claim 19, wherein the fuel nozzle is conductive.

23. A non-transitory computer readable media carrying computer executable instructions configured to cause an electronic control module to perform the method of claim 1 and further comprising the steps of:

receiving a signal or operating a sensor to generate a signal indicative of a fuel condition;

calculating or looking up a position along a stream of the fuel, the position having a relationship to a lean flammability limit corresponding to the fuel condition; and outputting the position data corresponding to the position or a signal corresponding to the position to drive a conductive flame holder support to the position or outputting an indication of the position on an instrument for viewing by a user.

* * * * *